United States Patent [19]

Koga

[11] 4,186,906

[45] Feb. 5, 1980

[54] CONCRETE MOLD FASTENING DEVICE AND TOOL FOR SAID DEVICE

[76] Inventor: Noboru Koga, 4-13-5 Shimoshakujii, Nerima-ku, Tokyo, Japan

[21] Appl. No.: 896,045

[22] Filed: Apr. 13, 1978

[51] Int. Cl.[2] ..... E04G 17/06; E04G 17/08

[52] U.S. Cl. ..... 249/41; 249/42; 249/166; 249/213; 249/214; 249/216

[58] Field of Search ..... 249/42, 214, 166, 216, 249/43, 213, 40, 36, 41

[56] References Cited

U.S. PATENT DOCUMENTS

| | | | |
|---|---|---|---|
| 2,069,085 | 1/1937 | Day | 249/43 |
| 3,437,306 | 4/1969 | Gates | 249/43 |
| 3,490,730 | 1/1970 | Gates, Jr. | 249/216 |
| 3,676,031 | 7/1972 | Stinton et al. | 249/43 |
| 3,729,166 | 4/1973 | Buyken et al. | 249/214 |

*Primary Examiner*—Donald J. Arnold

*Attorney, Agent, or Firm*—Pearne, Gordon, Sessions

[57] ABSTRACT

A concrete mold fastening device for use in a concrete mold for holding mold members in a desired spaced relationship which comprises a spacer extending between and passing through said mold members, said spacer having an enlarged diameter stop flange and a pair of annular recesses on the opposite sides of said flange on each end portion thereof, inner holding means positioned on said each end outwardly of the outer one of said recesses, a fastening rod connected to the associated outer end of the spacer and external holding means positioned on the outer end of the associated fastening rod outside of said mold members.

1 Claim, 10 Drawing Figures

CONCRETE MOLD FASTENING DEVICE AND TOOL FOR SAID DEVICE

BACKGROUND OF THE INVENTION

This invention relates to a concrete mold fastening device for use in conjunction with a concrete mold to hold opposite and spaced mold members of the mold in a desired spaced relationship when a concrete structure is to be formed in the cavity defined between the mold members and more particularly, to a concrete mold fastening device of the above type which essentially comprises a separator and a pair of holders detachably mounted on the opposite end portions of the separator to be selectively permanently embedded in or removed out of the concrete structure as desired after the concrete structure has cured.

Generally, when a concrete structure is formed on a construction site, a separator in the form of an elongated bar is passed through opposite and spaced mold members which define a cavity therebetween for placing concrete until the opposite threaded extreme ends thereof protrude outwardly of the mold members, a pair of holders having a U-shaped cross-section are mounted on the opposite end portions of the separator inwardly of the mold members, pipes are applied against the outer surfaces of the mold members surrounding the protruding threaded extreme ends of the separator, holed retaining members are received on the protruding extreme ends of the separator by means of the holes in the retaining members until the retaining members abut against the pipes to hold the mold members in a desired spaced relationship in cooperation with the holders and pipes, concrete is placed into the cavity to form a concrete structure, the mold members, holders, pipes and retaining members are removed from the concrete structure after the concrete structure has cured and the cavities left in the surfaces of the concrete structure as the result of the removal of the holders are filled with finish mortar to give a pleasing appearance to the concrete structure surfaces. Alternatively, the holders are permanently retained on the separator within the cured concrete structure and plugs are inserted into the cavities of the holders.

However, in the conventional concrete mold fastening device of the above type, different types of holders have to be designed and manufactured for the system in which the holders are removed out of the concrete structure and the cavities in the concrete structure are filled with finish mortar and for the system in which the holders are permanently embedded in the concrete structure and the plugs are inserted into the holders, respectively. Thus, the conventional concrete mold fastening device has the disadvantages that the holders generate a substantial amount of waste in material in the manufacture of the holders and a great deal of mental burden is imposed on the operator in determining which type of holders should be selected in the formation of different concrete structures.

SUMMARY OF THE INVENTION

Thus, the present invention has been developed in order to perfectly eliminate the disadvantages inherent in the conventional concrete mold fastening device referred to hereinabove.

According to one aspect of the present invention, shearing areas are formed on the opposite end portions of a separator in the form of an elongated bar, enlarged diameter stop flanges are formed adjacent to and inwardly of the shearing areas and washers and detachable holders are mounted on the separator outwardly of the shearing areas on the opposite end portions thereof with the washers adjacent to the flanges, whereby when the separator is sheared at the shearing areas after a concrete structure has cured, since the outer surface of each of the washers and the inner surface of the associated holder are positioned adjacent to each other, the flange first receives the shearing force and the holder does not receive the shearing force directly to thereby prevent the holder from inadvertently displacing along and/or coming off the separator.

According to another aspect of the present invention, a leakage water restraining disc is mounted on the separator between each of the stop flanges and the associated washer whereby leakage water which will flow from the concrete structure is positively prevented from flowing along the outer periphery of the separator by the cooperation between the associated stop flange and washer resulting in prevention of the appearing of rust on the surfaces of the concrete structure. Furthermore, the associated stop flange and washer positively prevent external rain water from invading into the concrete structure.

According to another aspect of the present invention, each of the holders of U-shaped cross-section adapted to be detachably mounted on the opposite end portions of the separator is provided on the outer periphery thereof with a spiral rib and a center hole in the bottom wall which hole has a plurality of equally spaced tongue pieces extending radially and inwardly toward the axis of the holder and the holder further defines a polygonal cavity therein. The tongue pieces positively hold the holder on the separator to thereby prevent the holder from inadvertently displacing along the separator. When it is desired to remove the holder after the concrete structure has cured ready to finish the cavity left in the concrete structure with mortar, the holder can be easily removed from the separator by inserting a simple tool having one similar polygonal end into the polygonal cavity in the holder and turning the tool to thereby substantially improve the operation efficiency. The tongue pieces on the bottom of the holder positively hold the holder on the separator against inadvertent displacement along and/or coming off the separator. The tongue pieces have a resiliency sufficient to accommodate separators of different diameters.

According to a further aspect of the present invention, a tool having a polygonal working portion at one end adapted to be received in the polygonal cavity in the holder and a handle at the other end for turning the holder out of the separator.

The above and other aspects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
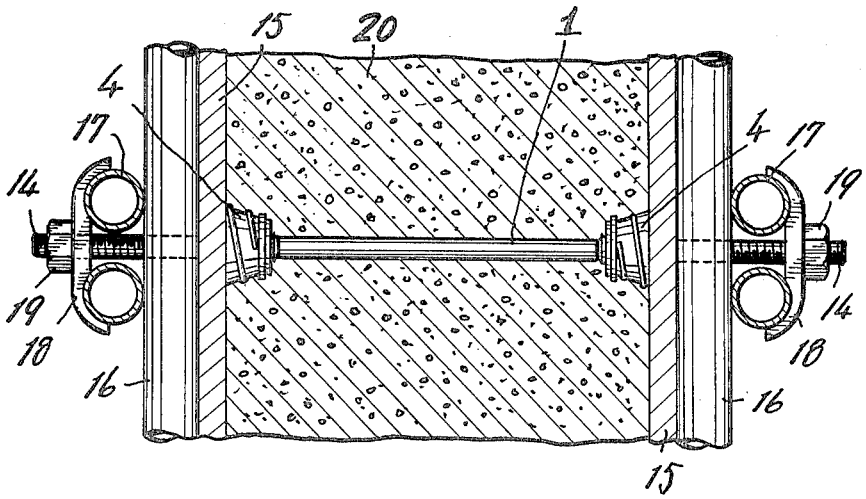
FIG. 1 is a schematic side elevational view in partial section of the preferred embodiment of concrete mold fastening device constructed in accordance with the present invention showing said fastening device in its operative position for holding mold members of a concrete mold in spaced relationship.
Figure 2:
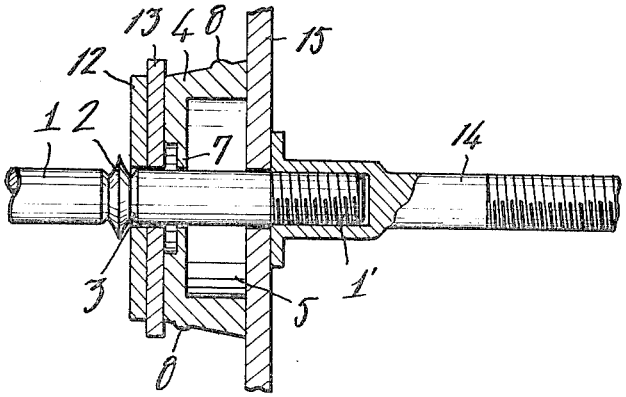
FIG. 2 is a fragmentary side elevational view in partial section on an enlarged scale of the parts of said mold fastening device associated with the righthand mold member as shown in FIG. 1.
Figure 3:
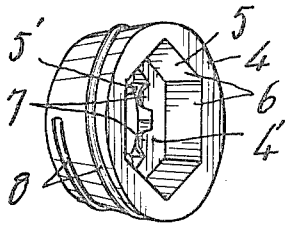
FIG. 3 is a perspective view of the holder unit of said mold fastening device as shown in FIG. 2.
Figure 4:
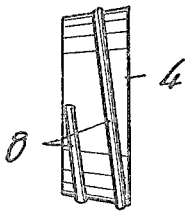
FIG. 4 is a side elevational view of said holder as shown in FIG. 3.

The present invention will be now described referring to the accompanying drawings and more particularly, to FIGS. 1 through 6 in which the preferred embodiment of concrete mold fastening device of the invention is shown. The mold fastening device generally comprises an elongated bar-shaped separator 1 extending horizontally between and through a pair of spaced and opposing mold members 15, 15 of a concrete mold which is to be fastened by the fastening device of the invention. The mold members 15, 15 define a cavity therebetween in which concrete 20 is to be placed. Each of the opposite end portions of the separator 1 is provided with a stop flange 2 having the diameter greater than the outer diameter of the rest of the separator 1 and also with a pair of spaced annular recesses 3, 3 on the opposite sides of the flange 2 and having the diameter smaller than the outer diameter of the rest of the separator.

The opposite end portions of the separator 1 are further provided with a pair of similar holder units 4 which are positioned adjacent to and outwardly of the respectively associated outer annular recesses 3 on the opposite end portions of the separator. Since the two holder units are identical with each other in construction and operation, only one of the holder units which is associated with one or the right-hand mold member 15 will be described hereinbelow. The holder unit comprises a detachable synthetic resin holder 4 which preferably has a hollow frusto-conical or cup shape as more clearly shown in FIGS. 3 and 4 and defines a polygonal cavity 5 having a plurality of contiguous faces 6, 6, . . . for the purpose to be described hereinafter. The bottom wall 4' of the cup-shaped holder 4 is provided with a center through hole 5' (FIG. 3) and a plurality of circumferentially spaced pliable tongue pieces 7, 7, . . . which extend radially and inwardly from the wall defining the through hole 5' toward the axis of the holder. The space of the tongue pieces 7 can be optionally selected as desired. Although the cavity 5 is shown as having a hexagonal configuration in FIG. 3, the polygonal configuration of the cavity may be varied as desired within the scope of the invention.

A spiral rib 8 is formed on the outer periphery of the frusto-conical holder 4 to prevent the holder from inadvertently moving out of the concrete 20 when the holder unit is intended to be permanently embedded in the concrete 20 or facilitate the turning of the holder when the holder unit is removed out of the concrete. The inner surface of the holder 4 which defines the cavity 5 is provided with a spiral recess 4" for the purpose to be described hereinbelow.

Figure 5:
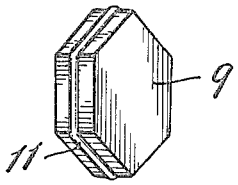
FIG. 5 is a perspective view of one of the plugs of said mold fastening device.
Figure 6:
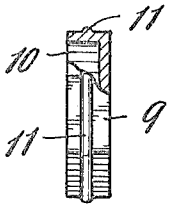
FIG. 6 is a side elevational view in partial section of said plug as shown in FIG. 5.
Figure 8:
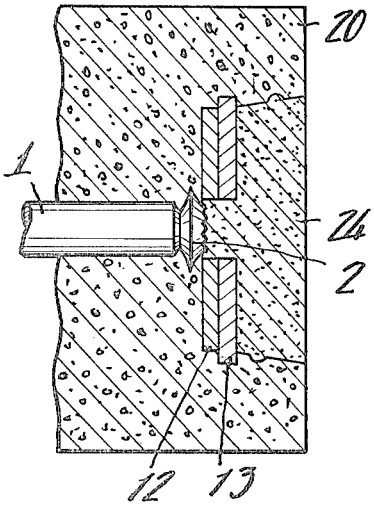
FIG. 8 is similar to FIG. 7, but shows said concrete structure with said holder and plug removed therefrom and mortar filling the cavity left in the concrete structure after the removal of the holder and plug.

FIGS. 5 and 6 show a hollow plug 9 of U-shaped cross-section which has a polygonal outer periphery corresponding to the polygonal configuration of the cavity 5 and defines a cavity 10 therein. A spiral rib 11 is formed on the outer periphery of the plug 9 and adapted to be received in the mating spiral recess 4" in the inner surface of the holder 4. The plug 9 is adpated to be fitted in the cavity 5 in the holder 4 only when the holder 4 is permanently embedded in the concrete 20 and can be eliminated when the holder is removed out of the concrete after the placed concrete has cured. The cavity left in the concrete 20 after the removal of the holder 4 is filled with finish mortar 24 as seen in FIG. 8. Reference numerals 12 and 13 denote a metal leakage water restraining disc and a washer, respectively positioned on the separator 1 between the stop flange 2 and holder 4.

Figure 7:
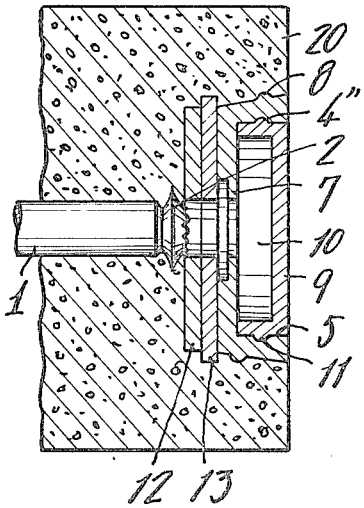
FIG. 7 is a fragmentary side elevational view in partial section on a reduced scale showing said parts of the mold fastening device in FIG. 2 in their embedded positions in a concrete structure with the holder closed by the plug.

In the operation mode shown in FIG. 7, after the placed concrete 20 has cured, first, the associated mold member 15 is removed, the separator 1 is broken or sheared at the outer annular recess 3 to remove the associated end portion of the separator and the plug 9 is inserted into the cavity 5 of the holder 4 which is permanently embedded in the concrete.

In the operation mode of FIG. 8, after the placed concrete 20 has cured, first, the particular mold member 15 is removed as in the case of the operation mode of FIG. 7, a tool 21 having a polygonal working portion 22 at one end and a handle 23 at the other end (FIG. 9) is inserted into the polygonal cavity 5 in the holder 4 by means of the working portion 22 and turned by means of the handle 23 to remove the holder 4 out of the concrete, the separator 1 is broken either before or after removal of holder 4, and the cavity left in the concrete after the removal of the holder 4 is filled with finish mortar 24 as shown in FIG. 8.

Figure 10:
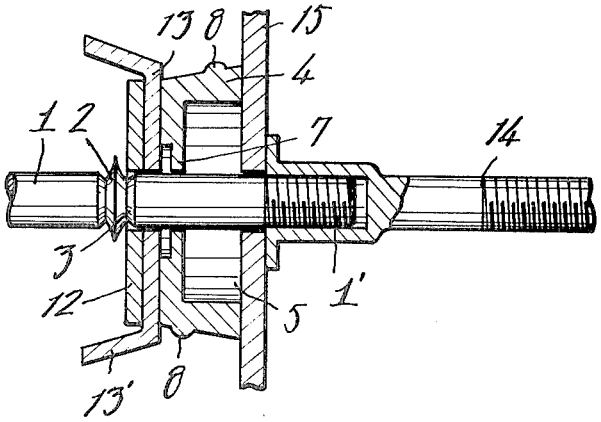
FIG. 10 is similar to FIG. 2, but shows a modification of said fastening device constructed in accordance with the present invention.

Turning now to FIG. 10 in which a modification of the embodiment of mold fastening device of the invention is shown, the modificaton is substantially similar to the foregoing embodiment except for the configuration of the metal leakage water restraining disc. The washer 13 of FIG. 10 has a cup shape having a peripheral flange 13' radially and outwardly extending at an angle with respect to the main body thereof to positively prevent leakage water from flowing from the concrete 20 along the outer periphery of the separator 1.

The operation of the mold fastening device of the invention as referred to hereinabove will be now described hereinbelow.

First of all, the leakage water restraining disc 12, washer 13 and holder are mounted on the section of the spacer 1 extending from the stop flange 3 on the particular end portion and terminating short of the extreme threaded end of the separator in the order described and the separator is then passed through the aligned holes (not shown) in the opposed and spaced mold members 15, 15 until the opposite threaded extreme ends of the separator are disposed outwardly of the mold members 15, 15. Fastening rods 14, 14 are threaded onto the opposite threaded extreme ends of the separator by means of the coupling portions at the inner ends thereof, a first pair of vertical pipes 16, 16 are disposed on the opposite sides of each fastening rod 14 sandwiching the rod and a second pair of horizontal pipes 17, 17 are disposed on the opposite sides of the fastening rod sandwiching the rod outside of the first pair of vertical pipes at right angles to the latter. Thereafter, a retaining plate 18 having a center hole (not shown) and a pair of spaced arcuate recesses in the inner surface for receiving the horizontal pipes 17, 17, respectively, is applied against the pipes 17, 17 on the side thereof opposite from the pipes 16, 16. Finally, nuts 19 on the associated fastening rods 14 are tightened to thereby fasten and hold the mold members 15, 15 together in a desired spaced relationship.

Thereafter, the concrete 20 is placed into the cavity defined between the thus fastened opposite mold members 15, 15 and left to cure. After the concrete 20 has cured, the nuts 19 are loosened, and the retaining plates 18, 18 and the fastening rods 14, 14 are removed in the order ready for the removal of the mold members 15, 15.

After the removal of the mold members 15, 15, the separator 1 is broken or sheared at the outer annular recesses 3, 3 on the opposite end portions of the separator 1 to separate the sections of the separator 1 extending outwardly from the outer annular recesses 3, 3. When it is desired to permanently embed the holders 4, 4 in the concrete 20, the plugs 9, 9 are inserted into the polygonal cavities 5, 5 in the holders 4, 4 and left as they are.

Figure 9:
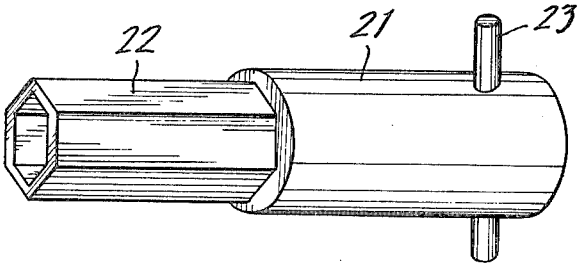
FIG. 9 is a perspective view of a tool for removing said holder out of said concrete structure.

However, when it is desired to finish the concrete with mortar and the like, after the removal of the mold members 15, 15 as described just above, the polygonal working portion 22 of the tool 21 as shown in FIG. 9 is inserted into the corresponding polygonal cavity 5 in one of the holders 4 and the tool is turned in the holder loosening direction until the holder is perfectly removed out of the concrete 20. The other holder 4 is also removed by the same tool 21 in the same manner as described in the first-mentioned holder 4. The removal of each of the holder 4 by the use of the tool 21 is facilitated by the spiral rib 8 on the holder 4. The cavities left in the concrete 20 after the removal of the holders 4, 4 are filled with finish mortar.

Since spacing and fastening device of the invention referred to hereinabove comprises the stop flanges, leakage water restraining discs and detachable holders mounted on the opposite end portions of the separator, the fastening device can be selectively employed either in the case where the cavities left in the concrete after the removal of the holders are filled with mortar or in the case where the holders are permanently embedded in the concrete and clogged with the plugs as desired and thus, the present invention provides practical advantages from the view point of industry and economy.

Furthermore, according to the present invention, since the leakage water restraining disc is interposed between the stop flange and washer on each end portion of the separator, rust from within the concrete is prevented from appearing on the surface of the concrete and rain water or the like on the surface of the concrete is prevented from entering the concrete.

Furthermore, since the holder has the spiral rib on the outer periphery and the polygonal cavity therein, the holder can be positively held in the concrete structure when the latter has once cured and prevented from displacing inadvertently if the holder is desired to be permanently retained in the concrete structure. In addition, the tongue pieces at the bottom of the holder serves to prevent the holder from inadvertently coming off the associated end portion of the separator and can positively engage the separators of different diameters because the tongue pieces have the inherent resiliency. Also, if the holder is desired to be removed out of the concrete structure after the latter has cured, the holder can be easily and effectively removed by inserting the tool into the polygonal cavity and turning the tool. The holder has a relatively small mass and can be simply and easily mounted on and removed from the separator.

While only one embodiment of the invention has shown and described in detail, it will be understood that the same is for illustration purpose only and not to be taken as a definition of the invention, reference being had for this purpose to the appended claims.

What is claimed is:

1. A concrete mold fastening device for use in conjunction with a concrete mold having opposing mold members, comprising a horizontal separator adapted to extend between and through the mold members with the opposite extreme ends protruding outwardly of the mold members and each end provided with an annular recess adjacent to and inwardly of each of the opposing mold members, said separator having an integral stop flange formed adjacent each annular recess, a detachable synthetic resin frusto-conical holder having a spiral rib on the outer surface, a polygonal cavity therein, a bottom wall defining one side of said cavity and having a center through hole and a plurality of pliable tongue pieces extending radially inwardly toward the axis of said separator, said bottom wall through hole being disposed on an end of said separator closer to said separator end than said stop flange, and a washer mounted on said separator in abutment against the outer surface of said bottom wall.

* * * * *